US010407905B2

(12) United States Patent
Neal

(10) Patent No.: US 10,407,905 B2
(45) Date of Patent: Sep. 10, 2019

(54) INTEGRATED PERIMETER POCKET

(71) Applicant: Worthington Armstrong Venture, Malvern, PA (US)

(72) Inventor: Joshua L. Neal, Elverson, PA (US)

(73) Assignee: Worthington Armstrong Venture, Malvern, PA (US)

( * ) Notice: Subject to any disclaimer, the term of this patent is extended or adjusted under 35 U.S.C. 154(b) by 0 days.

(21) Appl. No.: 15/317,744

(22) PCT Filed: Oct. 10, 2016

(86) PCT No.: PCT/US2016/056237

§ 371 (c)(1),
(2) Date: Dec. 9, 2016

(87) PCT Pub. No.: WO2017/062939

PCT Pub. Date: Apr. 13, 2017

(65) Prior Publication Data

US 2018/0202157 A1 Jul. 19, 2018

Related U.S. Application Data

(60) Provisional application No. 62/284,807, filed on Oct. 9, 2015.

(51) Int. Cl.
*E04B 9/30* (2006.01)
*E06B 9/17* (2006.01)
(Continued)

(52) U.S. Cl.
CPC ..... *E04B 9/30* (2013.01); *E06B 9/1703* (2013.01); *E06B 9/42* (2013.01); *E06B 9/50* (2013.01);
(Continued)

(58) Field of Classification Search
CPC . E06B 9/1703; E06B 9/50; E06B 9/42; E04C 2003/0473; F21V 15/01; F21V 21/025
(Continued)

(56) References Cited

U.S. PATENT DOCUMENTS 826,904 A * 7/1906 Spelman ..... E04B 9/30 52/506.06
2,389,171 A * 11/1945 Urbain ..... E04B 9/30 52/283
(Continued)

FOREIGN PATENT DOCUMENTS

DE 3643075 8/1987
DE 8702250 3/1988
(Continued)

OTHER PUBLICATIONS

International Search Report for International Application No. PCT/US2016/056237 Issued by the European Patent Office, the elected International Searching Authority, dated Jan. 24, 2017.

*Primary Examiner* — Brian E Glessner
*Assistant Examiner* — Adam G Barlow
(74) *Attorney, Agent, or Firm* — Stradley Ronon Stevens & Young, LLP

(57) ABSTRACT

A system including a wall-mount hook and a perimeter pocket. The wall-mount hook is attached to a wall and includes a wall contacting portion having a top and a bottom, and a upward facing hook between the top and the bottom of the wall contacting portion. The pocket includes a top portion attached to a first and second leg on opposite ends of the top portion extending downwardly. The pocket further includes a wall attachment region including a downward facing hook and a ledge on an exterior surface of the pocket. The first leg contacts the wall, the bottom of the wall contacting portion slots into the ledge of the wall attachment region, and the downward facing hook of the wall attach-
(Continued)

ment region rests on the upward facing hook of the wall-mount hook. The connection between the wall-mount hook and the pocket constrains lateral and vertical movement of the pocket.

13 Claims, 16 Drawing Sheets

(51) Int. Cl.

| | |
|---|---|
| ***E06B 9/42*** | (2006.01) |
| ***E06B 9/50*** | (2006.01) |
| ***F21V 21/02*** | (2006.01) |
| ***F21V 15/01*** | (2006.01) |
| *E04C 3/04* | (2006.01) |

(52) U.S. Cl.
CPC ..... *F21V 15/01* (2013.01); *F21V 21/025* (2013.01); *E04C 2003/0417* (2013.01); *E04C 2003/0434* (2013.01); *E04C 2003/0473* (2013.01)

(58) Field of Classification Search
USPC ..... 52/506.06, 506.08, 506.09, 506.1
See application file for complete search history.

(56) References Cited

U.S. PATENT DOCUMENTS

| | | | | |
|---|---|---|---|---|
| 4,858,409 | A * | 8/1989 | Handley | E04B 9/30 52/506.09 |
| 6,430,888 | B1 * | 8/2002 | Dombchik | E04C 3/06 52/653.1 |
| 9,617,785 | B2 * | 4/2017 | Chou | E06B 9/24 |
| 2005/0205216 | A1 * | 9/2005 | Vrielink | E06B 9/323 160/23.1 |
| 2013/0105649 | A1 * | 5/2013 | Wills | E06B 9/42 248/224.8 |
| 2014/0226327 | A1 * | 8/2014 | Yaphe | F21V 5/04 362/235 |
| 2016/0195250 | A1 * | 7/2016 | Park | F21S 8/038 362/219 |
| 2017/0114593 | A1 * | 4/2017 | Hebeisen | E06B 9/17007 |
| 2018/0202157 | A1 * | 7/2018 | Neal | E04B 9/30 |

FOREIGN PATENT DOCUMENTS

| | | | | |
|---|---|---|---|---|
| DE | 202013102263 | | 9/2013 | |
| EP | 2770153 | | 8/2014 | |
| EP | 2843179 | | 3/2015 | |
| EP | 2843179 | B1 * | 12/2016 | E06B 9/17023 |
| GB | 2479976 | | 11/2011 | |
| JP | 2006249880 | | 9/2006 | |

* cited by examiner

INTEGRATED PERIMETER POCKET

RELATED APPLICATIONS

This application is the United States National Phase of International Application No. PCT/US2016/056237 filed on Oct. 10, 2016, which claims the benefit of priority to U.S. Provisional Patent Application Ser. No. 62/284,807, filed on Oct. 9, 2015, the contents of which are incorporated in this application by reference.

FIELD OF THE INVENTION

The present invention relates generally to ceiling systems and more particularly to an integrated pocket at the perimeter of a ceiling system.

BACKGROUND OF THE INVENTION

Some ceiling systems include a grid support system hung from an overhead structure (i.e., a suspended ceiling system) which includes an array of orthogonally intersecting longitudinal grid support members and lateral grid support members arranged in a fairly uniform pattern with regular intervals. The longitudinal grid support members and the lateral grid support members define a plurality of grid openings configured to support individual ceiling panels. Mechanical and electrical utilities (such as wiring, plumbing, etc.) may be conveniently routed in a hidden manner in the cavity or plenum formed above the grid support members and ceiling panels, making suspended ceiling systems a practical and popular ceiling option for residential, commercial, and industrial building spaces.

It is often desirable to create a pocket along the perimeter of the suspended ceiling into which various components may be installed, including window shades and wire management devices. Traditionally, this detail is completed with studs and drywall materials, and the architect details this part of the building with little planning or thought to how it gets constructed. As a result, ceiling light coves are often needlessly complex and difficult to construct, and therefore very expensive due to this added labor. Such perimeter pockets are further often not suitable for use in areas where there is a risk of seismic activity.

Accordingly, there is a need for perimeter pockets which offer predictable seismic performance as well as simple and inexpensive installation.

SUMMARY

According to an embodiment of the invention, a perimeter pocket is provided including a top portion attached to a first leg and a second leg on opposite ends of the top portion, and a wall attachment region at the intersection of the first leg and the top portion. The first leg and the second leg extend downward from the top portion. The wall attachment region includes a downward facing hook and a ledge on an exterior surface of the perimeter pocket. The perimeter pocket may further include a plurality of protuberances on an interior surface of the perimeter pocket. The plurality of protuberances may include a screw hole and an upward facing hook on the second leg for attaching a closure clip to the perimeter pocket. The plurality of protuberances may include an upward facing hook and a screw hole on the first leg for attaching a window shade to the perimeter pocket. The plurality of protuberances may include a ledge on the second arm and a screw hole on the top portion for attaching a wire management device to the perimeter pocket. The plurality of protuberances may include a plurality of screw holes in one or more of the top portion, the first leg, and the second leg for attaching an end cap to the perimeter pocket. The perimeter pocket may further include a plurality of protuberances on the exterior of the second leg for attaching a ceiling beam to the perimeter pocket. The perimeter pocket may further include a horizontal ledge attached to the second leg.

According to another embodiment of the invention, a perimeter pocket system is provided including a wall mount hook and a perimeter pocket. The wall mount hook attaches to a wall and includes a wall contacting portion having a top and a bottom, and a upward facing hook between the top and the bottom of the wall contacting portion. The perimeter pocket includes a top portion attached to a first leg and a second leg on opposite ends of the top portion, and a wall attachment region. The first leg and the second leg extend downwardly from the top portion. The wall attachment region includes a downward facing hook and a ledge on an exterior surface of the perimeter pocket. The first leg of the perimeter pocket contacts the wall, the bottom of the wall contacting portion slots into the ledge of the wall attachment region, and the downward facing hook of the wall attachment region rests on the upward facing hook of the wall mount hook. The connection between the wall mount hook and the perimeter pocket constrains lateral and vertical movement of the perimeter pocket.

The perimeter pocket system may further include a window shade having a downward facing hook and a lower arm and the perimeter pocket may further include an upward facing hook and a screw hole on the first leg. The downward facing hook of the window shade rests on the upward facing hook of the perimeter pocket and the lower arm is secured to the perimeter pocket by a screw inserted into the screw hole on the first leg.

The perimeter pocket system may further include a wire management device including a horizontal upper arm and a vertical lower arm and the perimeter pocket may further include a ledge on the second arm and a screw hole on the top portion. The vertical lower arm rests on the ledge and the horizontal upper arm is secured to the perimeter pocket by a screw inserted into the screw hole on the top portion.

The perimeter pocket system may further include a closure clip including a horizontal portion and a downward facing hook and the perimeter pocket may further include an upward facing hook on the second leg. The downward facing hook of the closure clip rests on the upward facing hook on the second leg. The closure clip may be secured to the perimeter pocket by a tether including a first screw and a second screw at each end of the tether. The first screw attaches to a screw hole on the closure clip and the second screw attaches to a screw hole on the interior of the second leg of the perimeter pocket. Alternatively, the closure clip may be secured to the perimeter pocket by a screw inserted through the second leg of the perimeter pocket above the upward facing hook. The screw prevents vertical movement of the closure clip. The closure clip may extend fully between the first leg and the second leg, or only partially between the first leg and the second leg.

The perimeter pocket system may further include an end cap including an end plate which is secured to the perimeter pocket by a plurality of screws inserted in a plurality of screw holes in one or more of the top portion, the first leg, and the second leg. The end cap may also include a leg perpendicular to the end plate and a notch at the intersection of the end plate and the leg.

The perimeter pocket system may also include a ceiling beam attached to the exterior of the second leg of the perimeter pocket via a connector clip slotted between a plurality of protuberances on the exterior of the second leg. The perimeter pocket may also include a horizontal ledge attached to the second leg. The ceiling beam rests on the horizontal ledge.

It is to be understood that both the foregoing general description and the following detailed description are exemplary, but are not restrictive, of the invention.

BRIEF DESCRIPTION OF DRAWING

The invention is best understood from the following detailed description when read in conjunction with the accompanying drawing. It is emphasized that, according to common practice, the various features of the drawing are not to scale. On the contrary, the various features are arbitrarily expanded or reduced for clarity. Included in the drawing are the following figures.

DETAILED DESCRIPTION

Figure 1A:
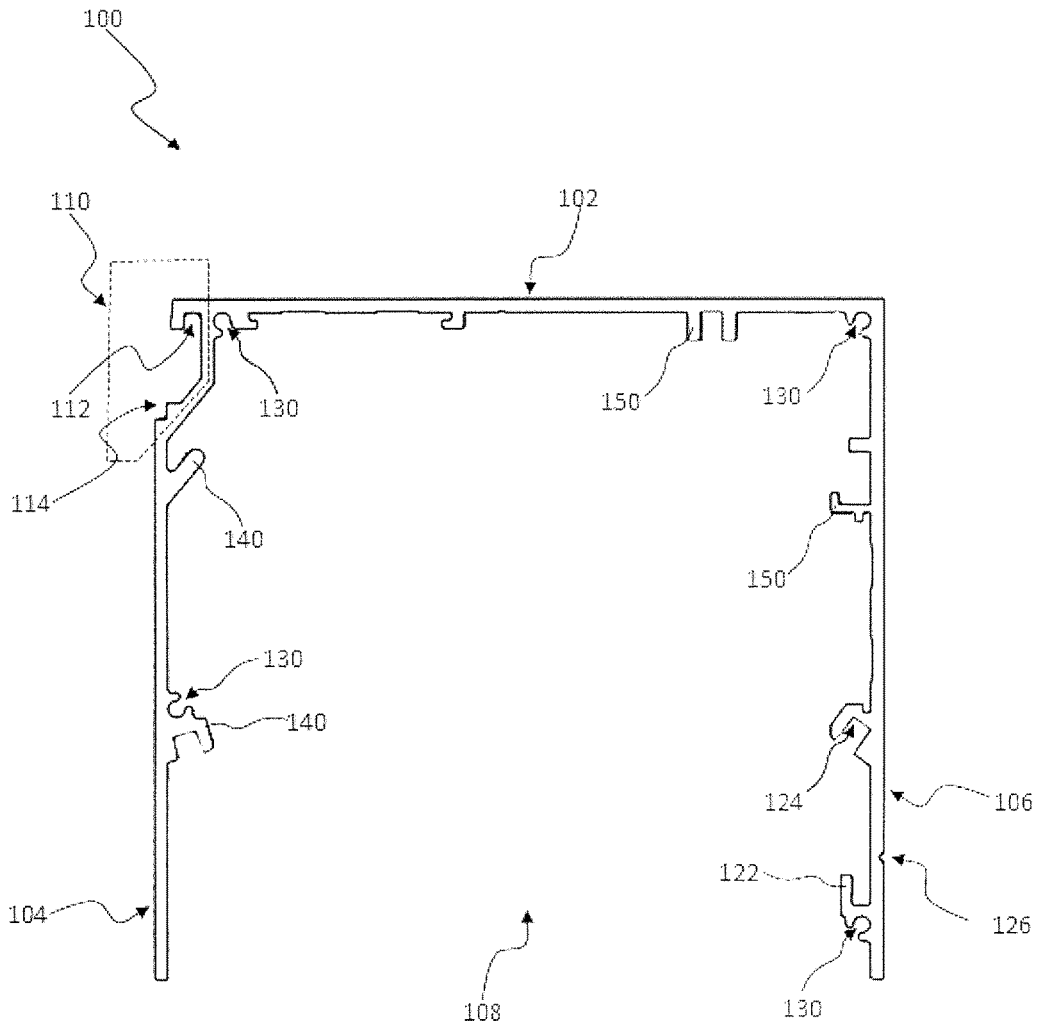
FIG. 1A is a side view of a perimeter pocket according an embodiment of the present invention.
Figure 1B:
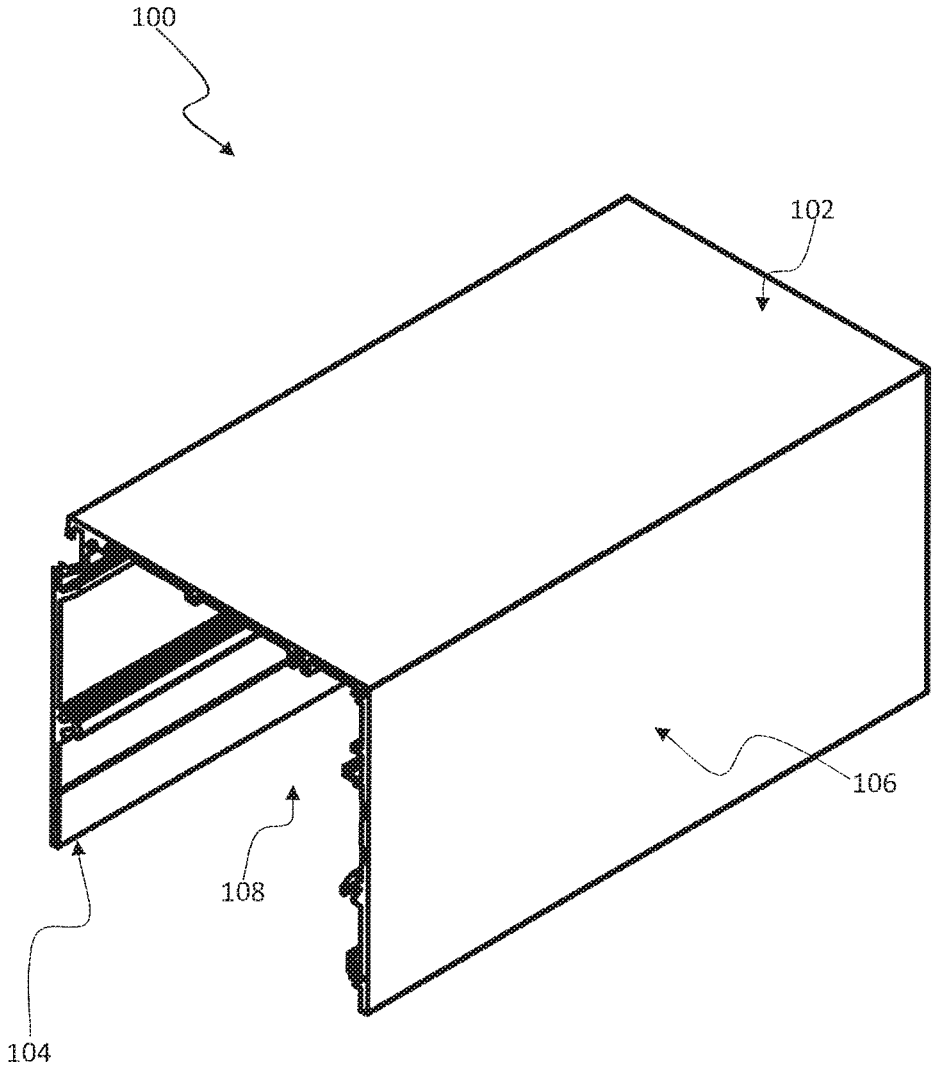
FIG. 1B is a perspective view of the perimeter pocket of FIG. 1A, according to an embodiment of the present invention.

Referring now to the drawing, in which like reference numbers refer to like elements throughout the various figures that comprise the drawing, FIGS. 1A-1B show a perimeter pocket 100 according an exemplary embodiment of the present invention. FIG. 1A depicts a side view of the perimeter pocket 100 according to an exemplary embodiment. FIG. 1B depicts a three dimensional view of the perimeter pocket 100. As discussed in more detail below, the perimeter pocket 100 may be attached to a wall at the perimeter of an integrated ceiling in order to provide a pocket in which one or more additional components may be installed. Additional components may include, but are not limited to, lighting components such as lamps, recessed lighting, and emergency signs; window covering components such as shades or blinds; and other attachments such as wire management guides. In a preferred embodiment, the perimeter pocket 100, as well as the other components discussed below, may be made of extruded aluminum. However, it will be understood that the components may also include other materials in addition to, or in place of, extruded aluminum, including other metals or plastics. For example, the perimeter pocket 100 may be made of extruded aluminum coated in a baked polyester paint finish.

The perimeter pocket 100 includes a top portion 102 attached a first leg 104 and a second leg 106 on opposite ends of the top portion 102. The first leg 104 and the second leg 106 extend downward from the top portion 102 and are preferably, but not necessarily, substantially parallel to each other and substantially perpendicular to the top portion 102. The bottom 108 of the perimeter pocket 100 is open. As used herein, the "interior" of the perimeter pocket 100 is defined as the region between the first leg 104 and the second leg 106, and the "exterior" of the perimeter pocket 100 is any space not between the first leg 104 and the second leg 106, for example the space above the top portion 102, the space to the left of the first leg 104, and the space to the right of the second leg 106. Accordingly, the interior surface of the perimeter pocket 100 is the surface adjacent to the interior of the perimeter pocket 100 and the exterior surface of the perimeter pocket 100 is the surface adjacent to the exterior of the perimeter pocket 100.

The first leg 104 is joined to the top portion 102 at a wall attachment region 110. The wall attachment region 110 includes a downward-facing hook 112 and a ledge 114 on the exterior surface of the perimeter pocket 100. As explained in greater detail below, the wall attachment region 110 allows the perimeter pocket 100 to be easily attached to a wall while limiting both horizontal and vertical movement after installation.

The interior of the perimeter pocket 100 also includes an upward facing hook 122 and a screw hole 124 for attaching a closure clip to cover the open bottom 108 of the perimeter pocket 100. The operation of the upward facing hook 122 and the screw hole 124 to secure the closure clip is described in more detail below. The perimeter pocket 100 also includes a plurality of screw holes 130 for attaching an end cap or cover to the perimeter pocket 100. It will be understood that the perimeter pocket 100 may include any number of additional protuberances on the interior or exterior of the perimeter pocket 100 which are not shown to attach additional components to the perimeter pocket 100. For example, a ceiling beam may attach to the second leg 106, and a hang wire may attach to the top portion 102 or the second leg 106.

The interior of the perimeter pocket 100 may also include one or more additional pluralities of protuberances, also commonly referred to as bosses, for attaching components to the interior of the perimeter pocket 100. For example, as described in more detail below, the plurality of protuberances 140 may be used to attach a window shade element to the perimeter pocket 100 and the plurality of protuberances 150 may be used to attach a wire management element to the perimeter pocket 100.

FIGS. 2A-6D depict installation of the perimeter pocket 100 on a wall 200 and installation of various components in the perimeter pocket 100.

Figure 2A:
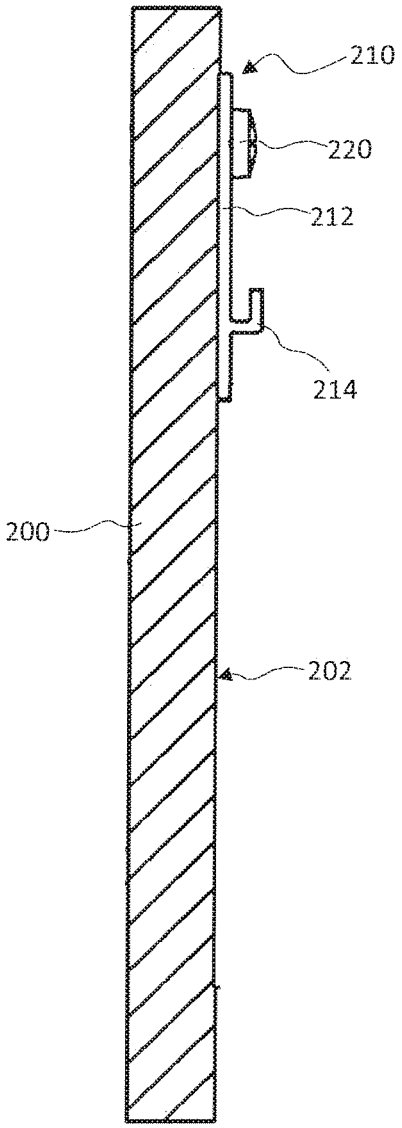
FIG. 2A is a side view of a wall mount hook attached to a wall, according to an embodiment of the present invention.
Figure 2B:
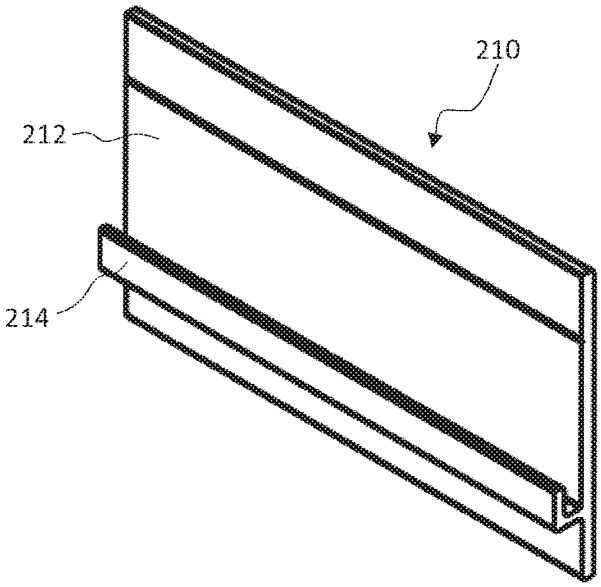
FIG. 2B is a perspective view of the wall mount hook of FIG. 2A, according to an embodiment of the present invention.

Referring to FIG. 2A, a wall mount hook 210 is attached to the wall 200 by a fastening element 220, such as a nail or a screw. The wall mount hook 210 includes a wall contacting portion 212 which substantially conforms to the surface 202 of the wall 200 and an upward-facing hook 214. FIG. 2B depicts a perspective view of the wall mount hook 210.

Figure 3:
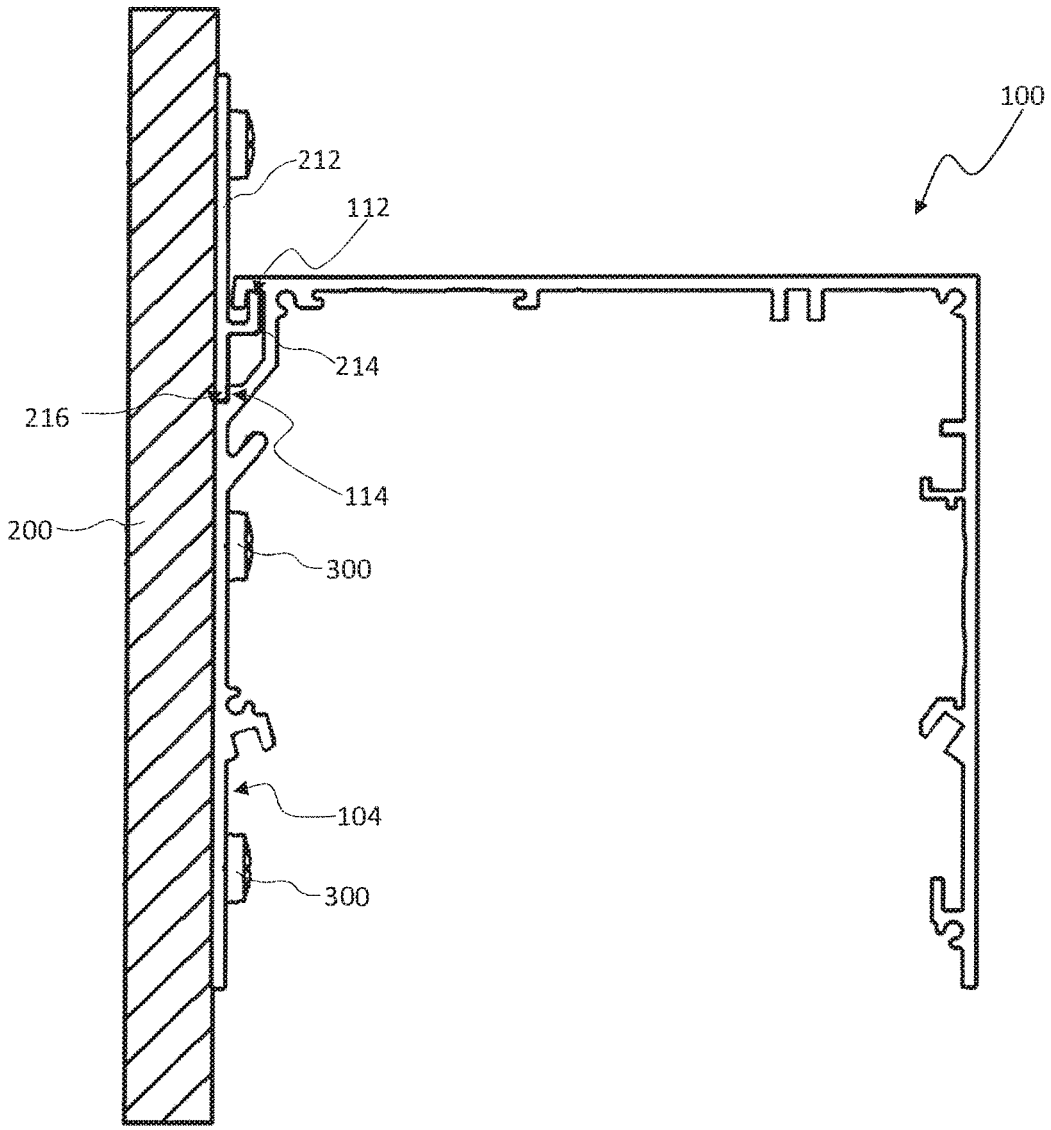
FIG. 3 is a side view of the perimeter pocket attached to the wall mount hook, according to an embodiment of the present invention.

Referring to FIG. 3, the perimeter pocket 100 is attached to the wall mount hook 210 by placing the downward-facing hook 112 of the perimeter pocket 100 over the upward-facing hook 214 of the wall mount hook 210. The perimeter pocket 100 is then rotated downward to bring the first leg 104 of the perimeter pocket 100 into contact with the wall 200. Once the perimeter pocket 100 is rotated into position, the bottom 216 of the wall contacting portion 212 slots into the ledge 114. Once in position, the perimeter pocket 100 is prevented from moving downwardly or away from the wall 200 by the upward-facing hook 214 and the downward-facing hook 112, and prevented from moving upwardly by the ledge 114. The constrained movement of the perimeter pocket 100 allows for a very stable connection between the wall 200 and the perimeter pocket 100, particularly in the case of a seismic event (e.g., an earthquake) when horizontal or vertical disturbance of the perimeter pocket 100 is more likely. Although not required, one or more additional fastening devices 300, such as screws or nails, may be used to attach the perimeter pocket 100 to the wall 200.

Figure 4:
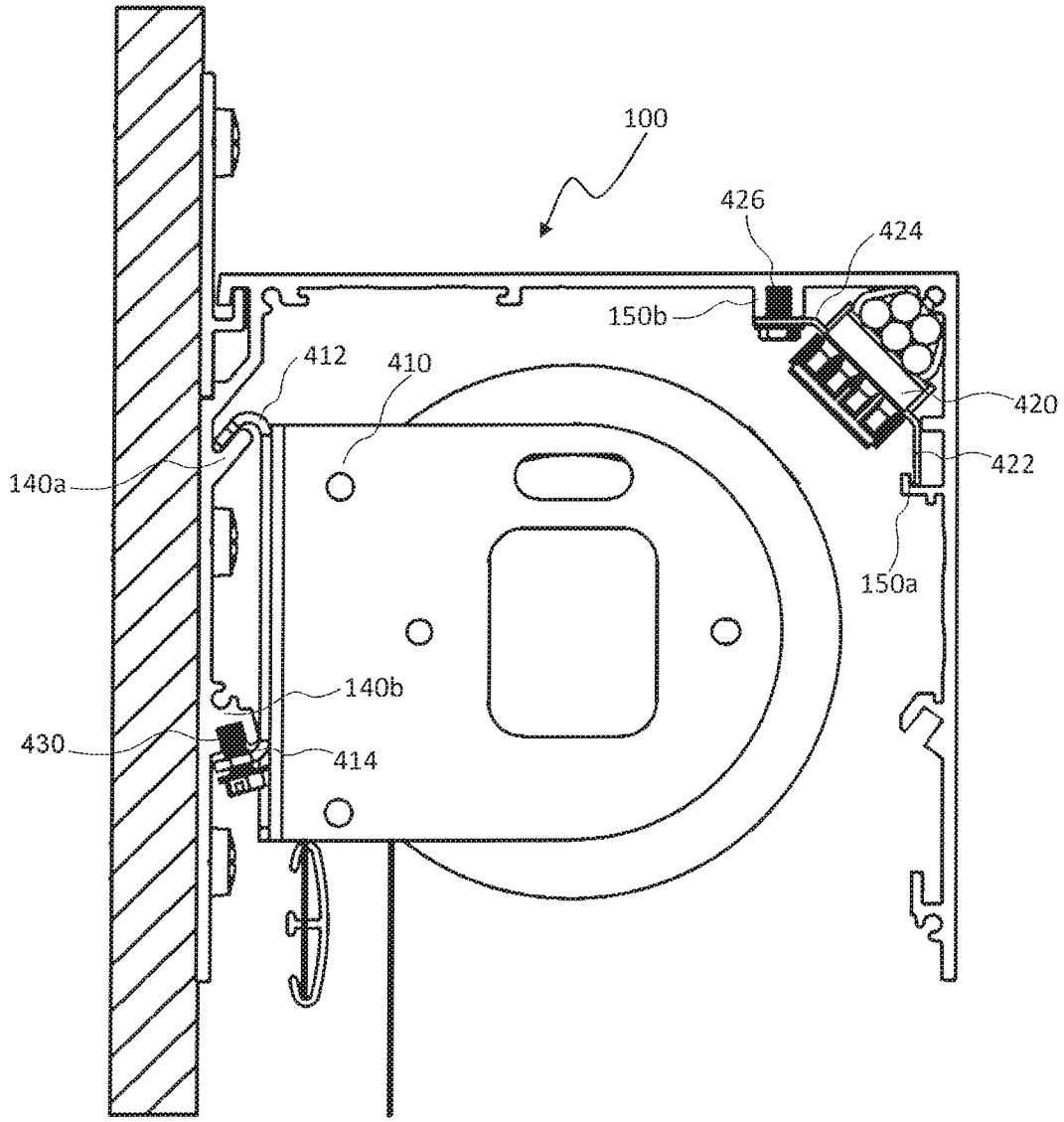
FIG. 4 is a side view of attaching a window shade and a wire management device inside the perimeter pocket, according to an embodiment of the present invention.

Referring to FIG. 4, once the perimeter pocket 100 is attached to the wall 200, additional components may be attached to the interior of the perimeter pocket 100, for example a window shade 410 and a wire management device 420. It will be understood that other components may be attached to the interior of the perimeter pocket 100 in place of, or in addition to, the window shade 410 and the wire management device 420. The window shade 410 and the wire management device 420 attach to the plurality of protuberances 140 and 150, respectively. In the depicted embodiment, the plurality of protuberances 140 include an upward-facing hook 140*a* and a screw hole 140*b*. The window shade 410 includes a downward facing hook 412 which sits on the upward facing hook 140*a*. Once the window shade 410 is resting on the upward-facing hook 140*a*, a lower arm 414 of the window shade 410 is attached to the screw hole 140*b* by a screw 430. The plurality of protuberances 150 includes a ledge 150*a* and a screw hole 150*b*. A lower arm 422 of the wire management device 420 rests on the ledge 150*a* and the wire management device 420 is rotated into position, after which an upper arm 424 is attached to the screw hole 150*b* by a screw 426.

Figure 5A:
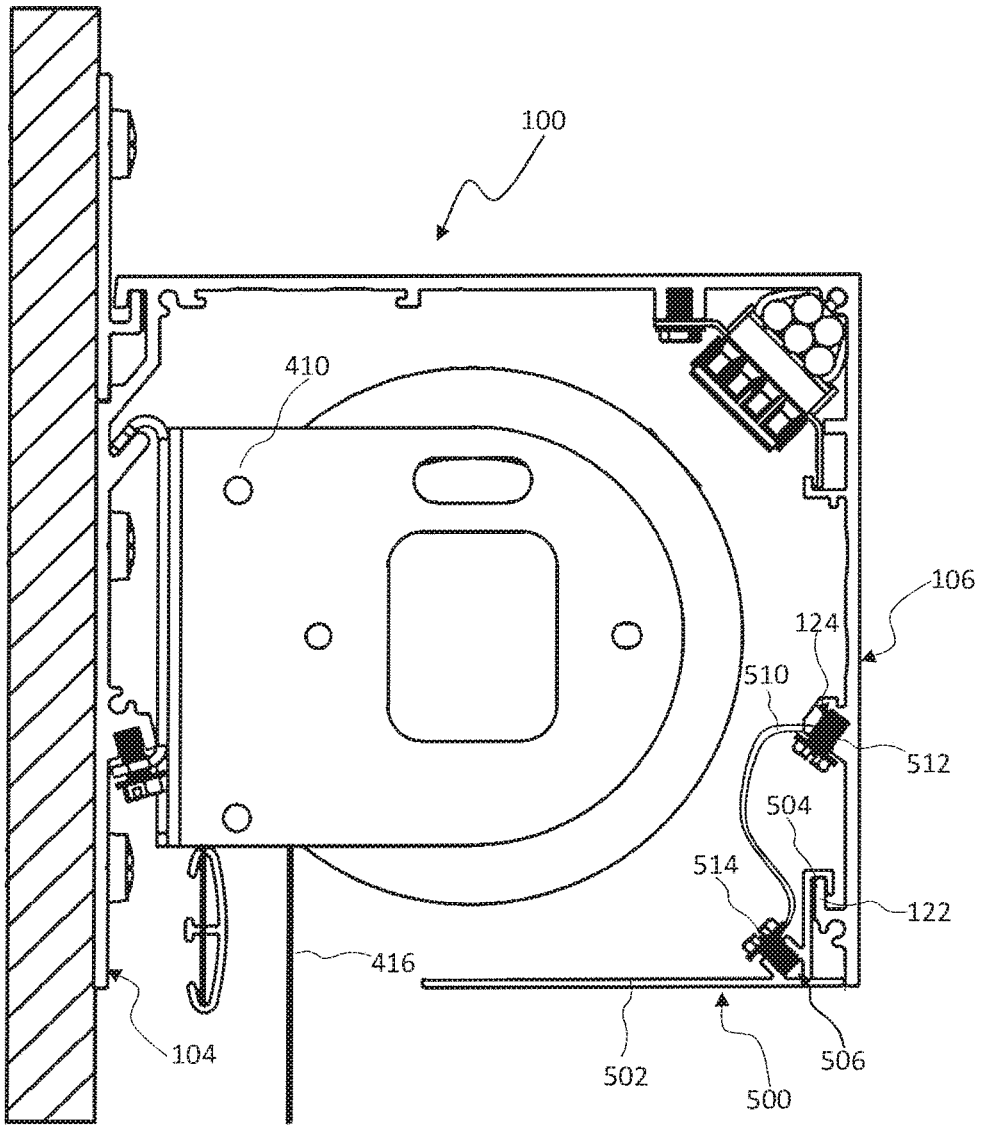
FIG. 5A is a side view of attaching a closure clip to the perimeter pocket with a tether, according to an embodiment of the present invention.
Figure 5B:
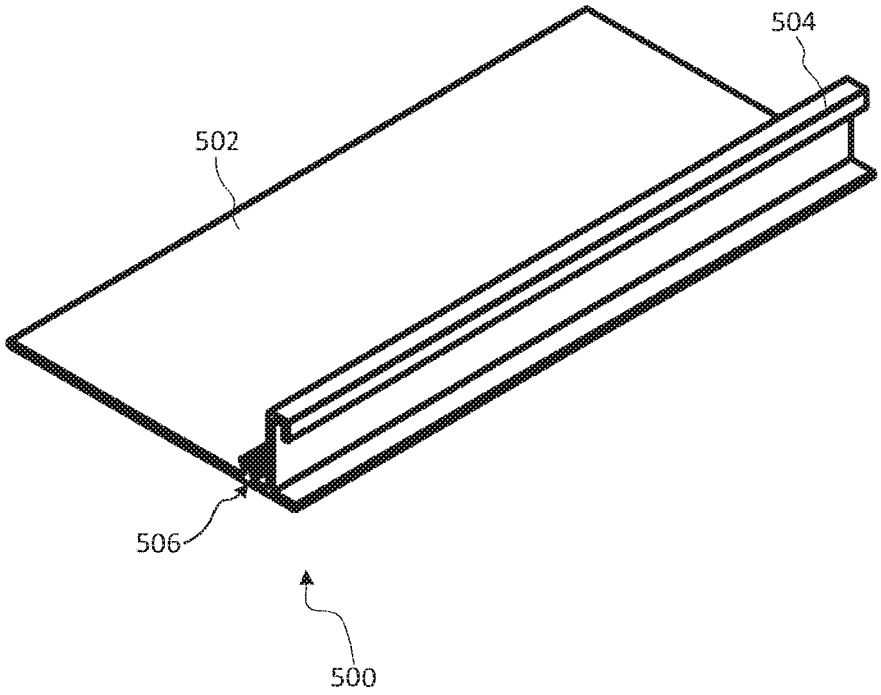
FIG. 5B is a perspective view of the closure clip of FIG. 5A, according to an embodiment of the present invention.

Referring to FIG. 5A, once the components are installed inside the perimeter pocket 100, the bottom 108 of the perimeter pocket 100 is at least partially closed by a closure clip 500. FIG. 5B depicts a perspective view of the closure clip 500. The closure clip 500 includes a horizontal portion 502, a downward facing hook 504, and a screw hole 506. Depending on the components installed in the perimeter pocket 100, the horizontal portion 502 may fully or only partially extend the distance between the first leg 104 and the second leg 106. For example, in the embodiment depicted in FIG. 5A, the window shade 410 includes a shade element 416 which extends beyond the interior of the perimeter pocket 100. Accordingly, the horizontal portion 502 extends only partially between the first leg 104 and the second leg 106 to not interfere with the shade element 416. The closure clip 500 is installed by hooking the downward facing hook 504 over the upward facing hook 122 of the perimeter pocket 100. The closure clip 500 may be further secured by a tether 510 which is attached to the perimeter pocket 100 by a first screw 512 which screws into screw hole 124 and a second screw 514 which screws into screw hole 506. In the event that an upward force removes the closure clip 500 from the upward facing hook 122, the tether 510 will prevent the closure clip 500 from falling.

Figure 5C:
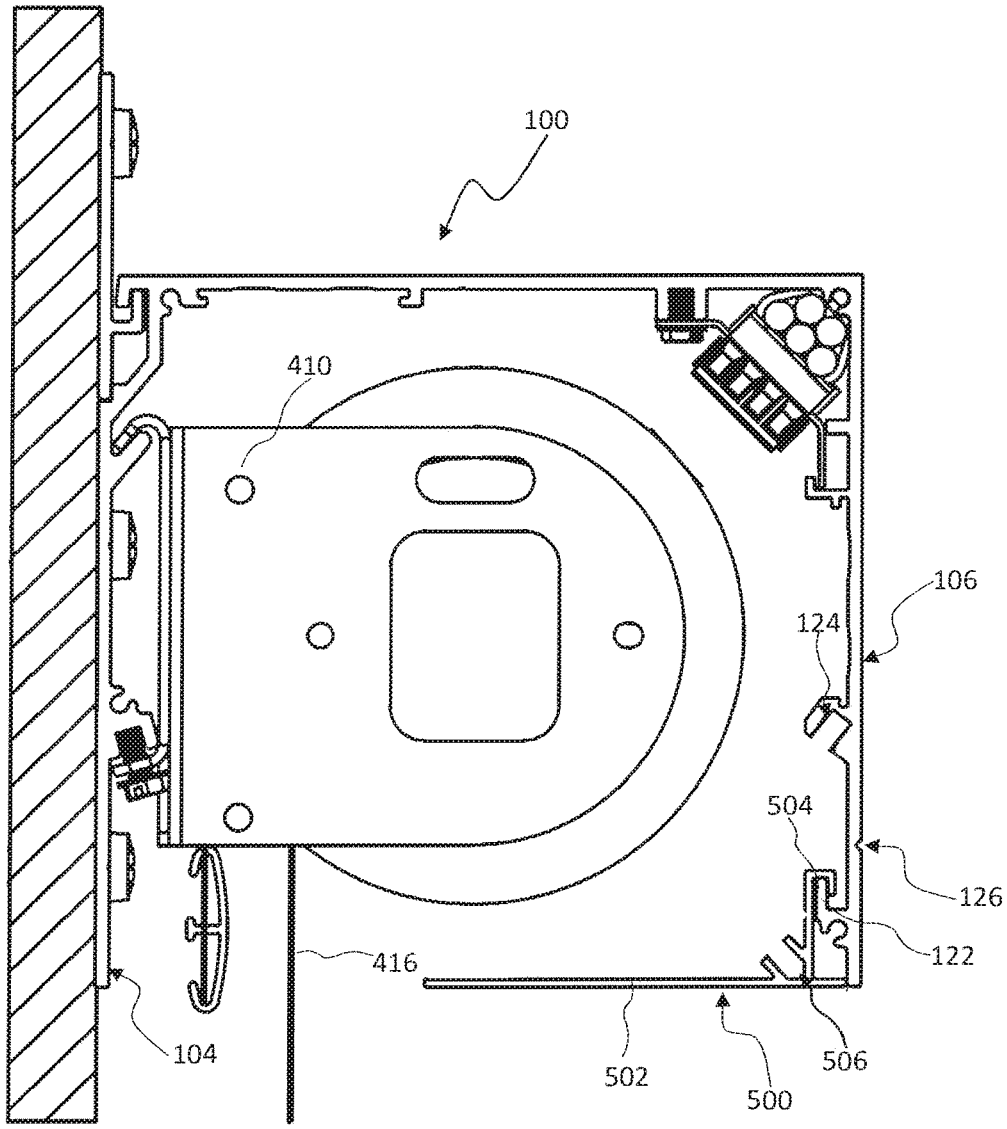
FIG. 5C is a side view of attaching the closure clip to the perimeter pocket including an impression, according to an embodiment of the present invention.
Figure 5D:
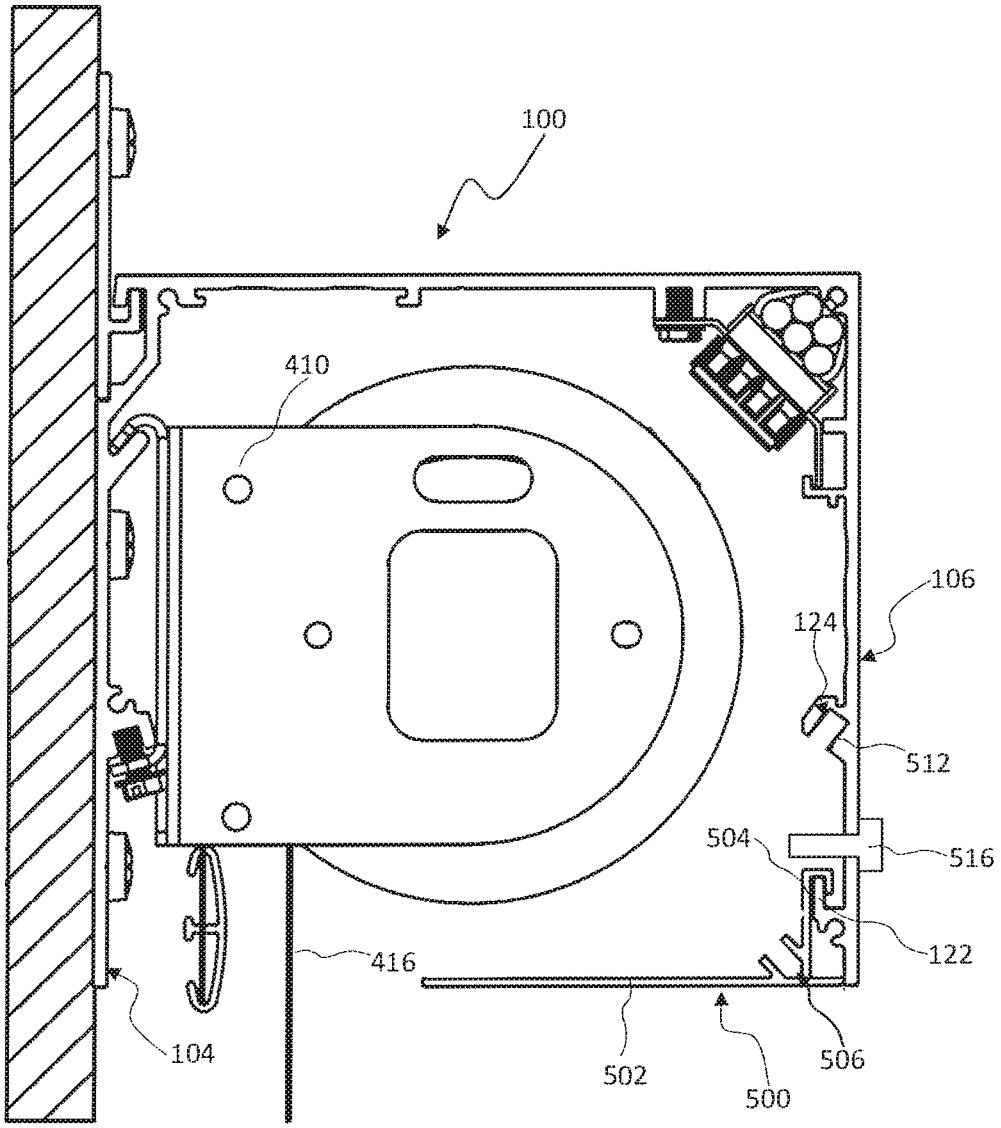
FIG. 5D is a side view of securing the closure clip of FIG. 5C with a screw screwed through the impression, according to an embodiment of the present invention.

Referring to FIGS. 5C-5D, in an alternate embodiment the closure mechanism may be secured by a screw rather than the tether 510. In such an embodiment, the perimeter pocket 100 preferably includes an impression 126 above the upward facing hook 122, as depicted in FIG. 5C. A screw 516 is screwed through the second leg 106 at the impression 126 such that the shank of the screw 516 is above the downward facing hook 504 and the upward facing hook 122 which prevents the closure clip 500 and the perimeter pocket 100 from separating. The impression 126 helps align the screw 516 for easier installation and ensure proper positioning of the screw 516 above the downward facing hook 504 and the upward facing hook 122.

Figure 6A:
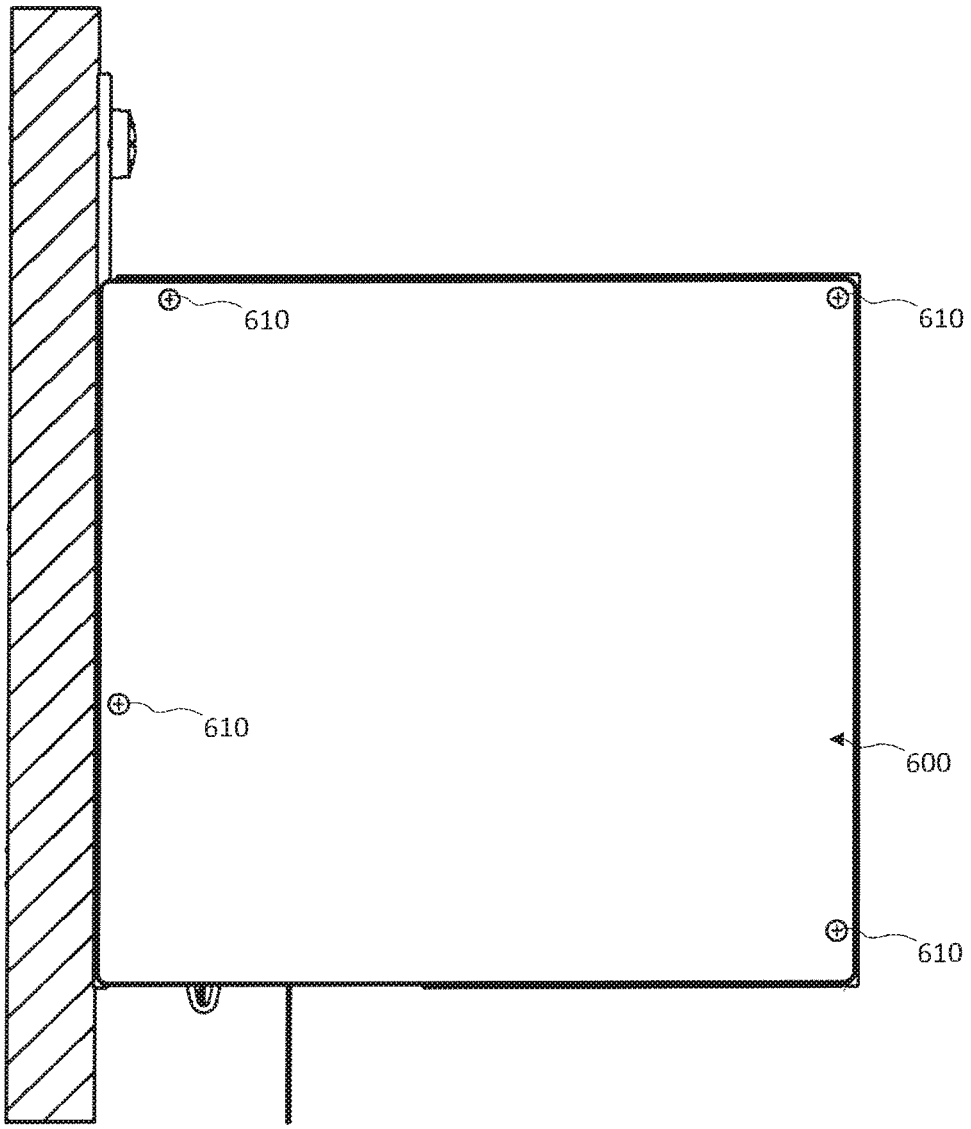
FIG. 6A is a side view of attaching an end cap to the perimeter pocket, according to an embodiment of the present invention.
Figure 6B:
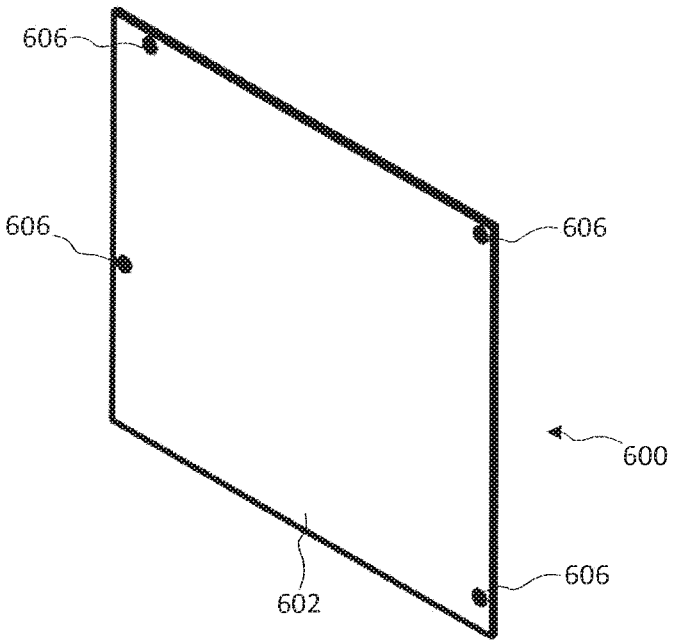
FIG. 6B is a perspective view of the end cap of FIG. 6A, according to an embodiment of the present invention.

Referring to FIG. 6A, once the closure clip 500 is attached to the perimeter pocket 100, the perimeter pocket 100 may be covered by an end cap 600 to protect the components installed in the interior of the perimeter pocket 100. The end cap 600 is secured to the perimeter pocket 100 by screws 610 which screw into the plurality of screw holes 130 (FIG. 1). The end cap 600 prevents interference with, and damage to, the components installed within the perimeter pocket 100, and improves the visual appearance of the installed ceiling. FIG. 6B depicts a perspective view of the end cap 600. As can be seen in FIG. 6B, the end cap 600 includes an end plate 602 having a plurality of holes 606 which align with the screw holes 130 (FIG. 1).

Figure 6C:
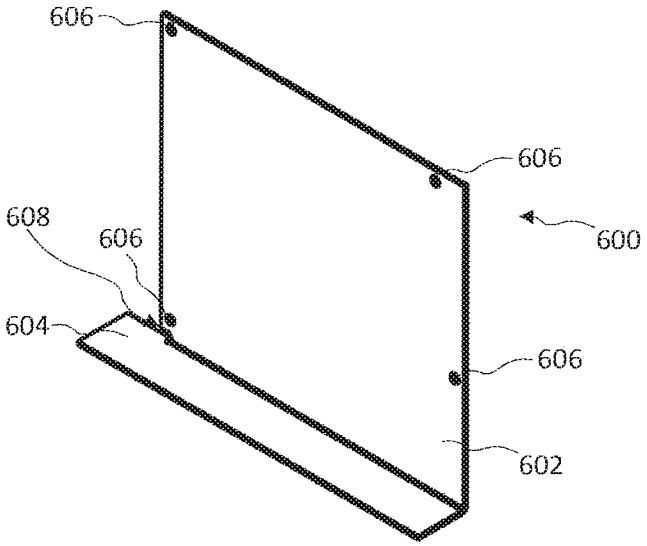
FIG. 6C is a perspective view of another end cap, according to an embodiment of the present invention.
Figure 6D:
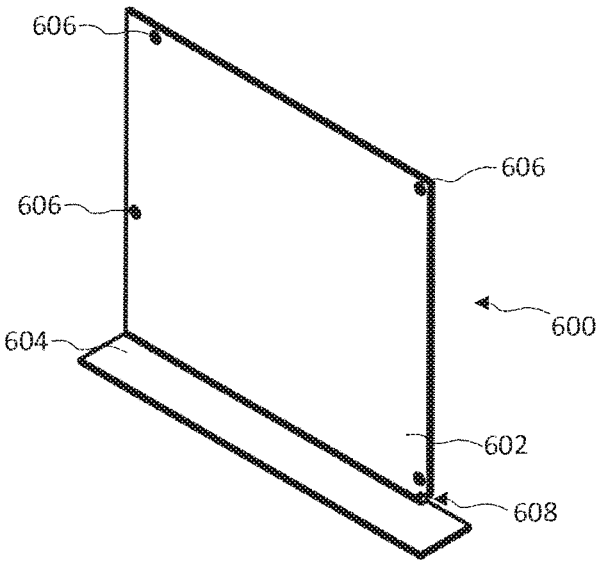
FIG. 6D is a perspective view of another end cap, according to an embodiment of the present invention.

Referring to FIGS. 6C and 6D, in an alternative embodiment the end cap 600 may be provided in both right handed (FIG. 6C) and left handed (FIG. 6D) configurations to cover each side of the perimeter pocket 100. As can be seen in FIGS. 6D and 6C, the end cap 600 may further include a leg 604 which is perpendicular to the end plate 602. The end cap 600 may also further include a notch 608 at the intersection of the end plate 602 and the leg 604 which allows the end cap 600 to sit flush with the perimeter pocket 100.

Figure 7A:
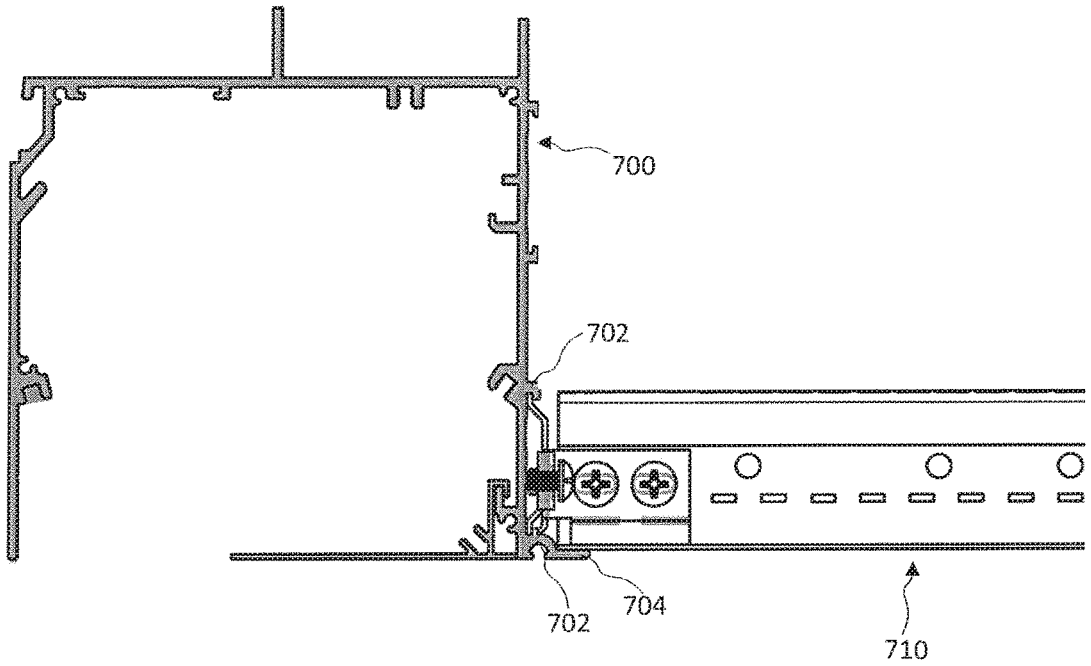
FIG. 7A is a side view of another perimeter pocket attached to a ceiling beam, according to an embodiment of the present invention.
Figure 7B:
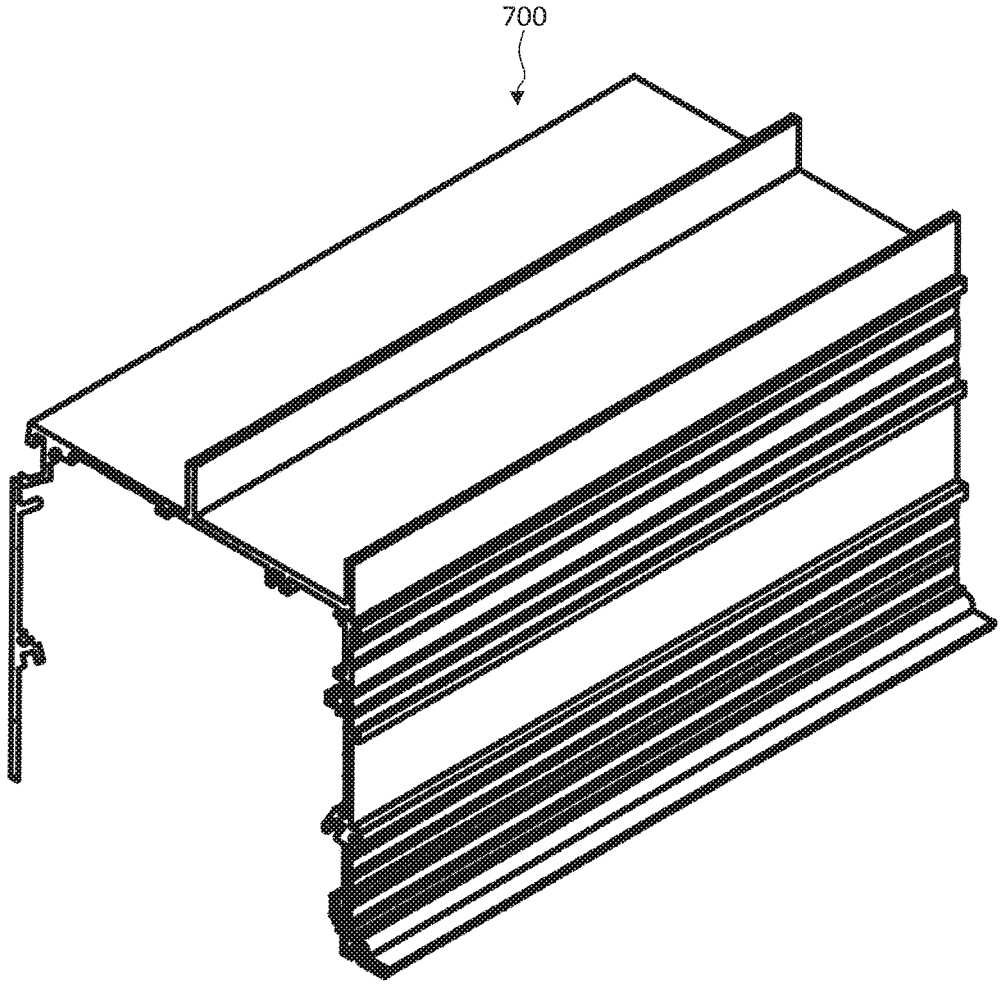
FIG. 7B is a perspective view of the perimeter pocket of FIG. 7A, according to an embodiment of the present invention.
Figure 7C:
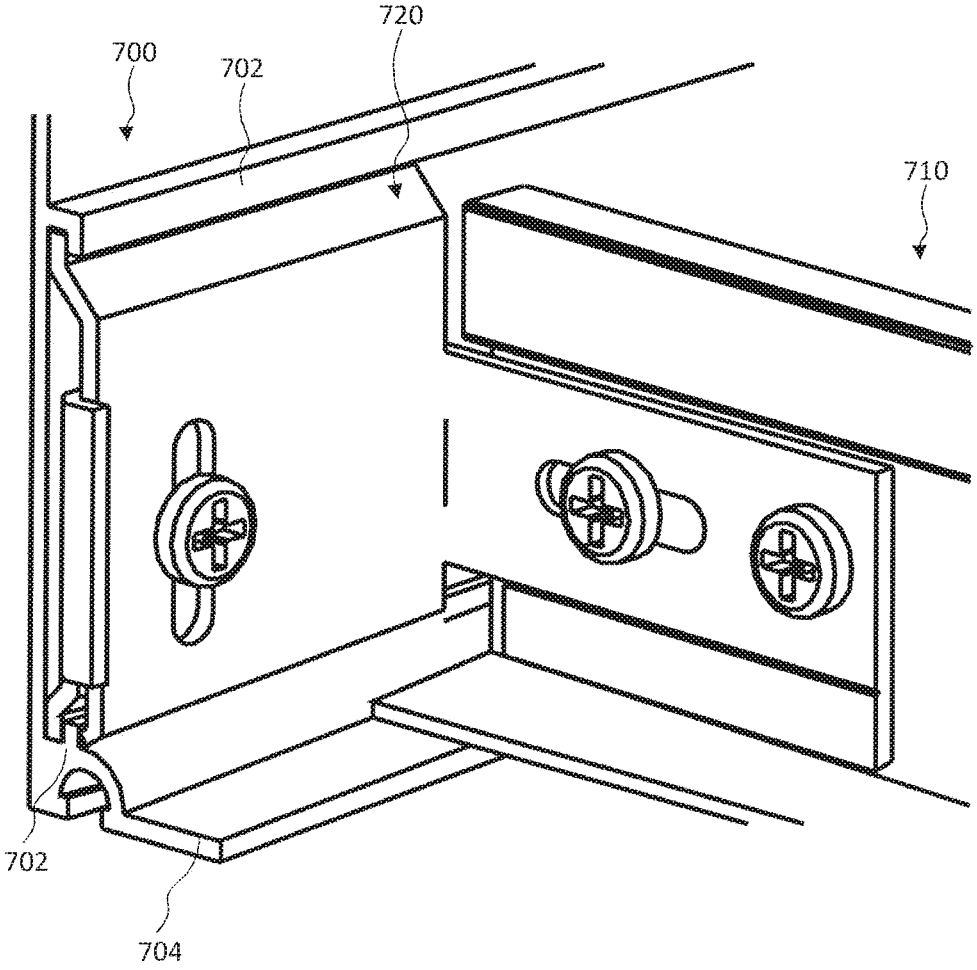
FIG. 7C is a perspective view of the perimeter pocket of FIG. 7A, according to an embodiment of the present invention.
Figure 8:
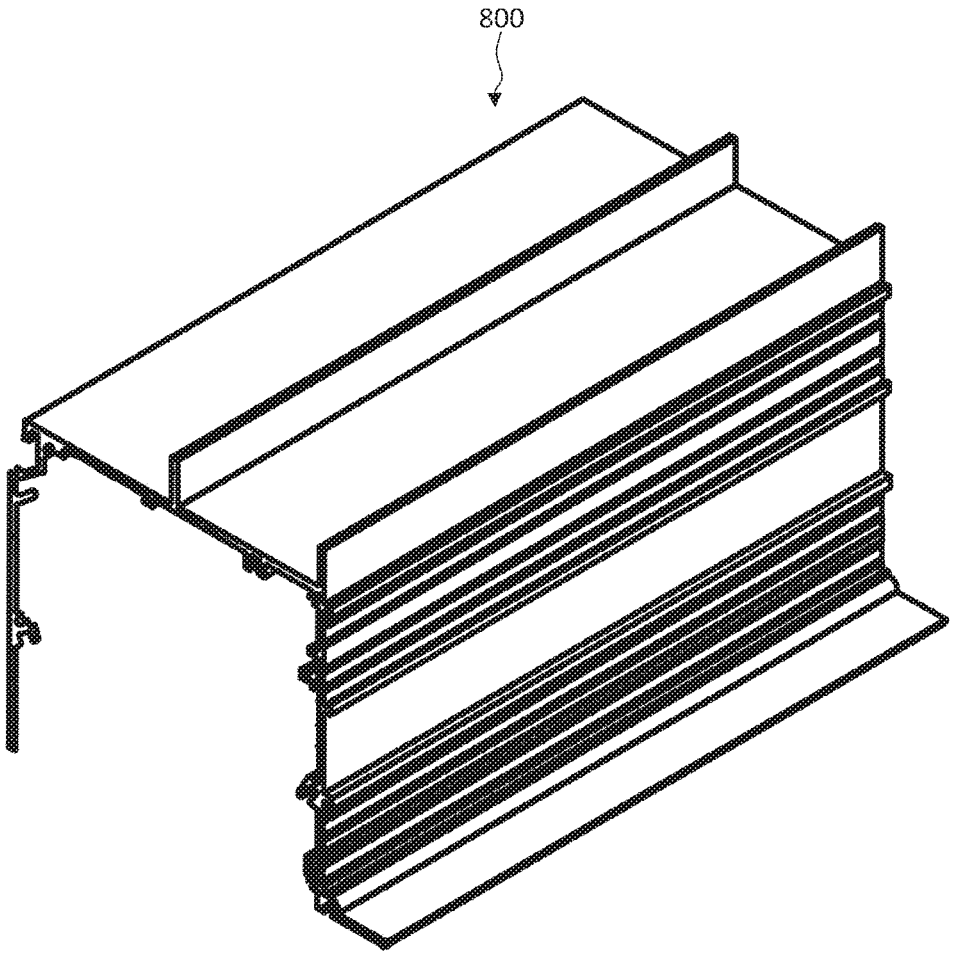
FIG. 8 is a perspective view of another perimeter pocket, according to an embodiment of the present invention.

Referring to FIGS. 7A-7C, another perimeter pocket 700 may be provided including additional exterior protuberances 702 for attaching a ceiling beam 710 to the perimeter pocket 700. A connector clip 720 may slot into the protuberances 702 and the ceiling beam 710 may be screwed into the connector clip 720. For additional support and stability, the perimeter pocket 700 may further include a ledge 704 on which the ceiling beam 710 rests. FIG. 7B depicts a three dimensional view of the perimeter pocket 700. FIG. 7C depicts a perspective view of the perimeter pocket 700 attached to the ceiling beam 710 by the connector clip 720. FIG. 8 depicts an additional perimeter pocket 800, according to another embodiment.

The foregoing description of preferred embodiments of the invention should be taken as illustrating, rather than as limiting, the present invention. As will be readily appreciated, numerous variations and combinations of the features set forth above can be utilized without departing from the present invention. Such variations are not regarded as a departure from the spirit and scope of the invention, and all such variations are intended to be included within the scope of the invention.

I claim:

1. A perimeter pocket system comprising:

a wall mount hook attached to a wall, the wall mount hook including a wall contacting portion having a top and a bottom, and an upward facing hook between the top and the bottom of the wall contacting portion;

a perimeter pocket including a top portion attached to a first leg and a second leg on opposite ends of the top portion, the first leg and the second leg extending downwardly from the top portion and the second leg including an upward facing hook, and a wall attachment region at the intersection of the first leg and the top portion, the wall attachment region including a downward facing hook and a ledge on an exterior surface of the perimeter pocket; and a closure clip including a horizontal portion and a downward facing hook, wherein the downward facing hook of the closure clip rests on the upward facing hook on the second leg of the perimeter pocket, wherein the first leg of the perimeter pocket contacts the wall, the bottom of the wall contacting portion slots into the ledge of the wall attachment region, and the downward facing hook of the wall attachment region rests on the upward facing hook of the wall mount hook, and wherein the connection between the wall mount hook and the perimeter pocket constrains lateral and vertical movement of the perimeter pocket.

2. The perimeter pocket system of claim 1, further comprising a window shade including a downward facing hook and a lower arm, wherein the perimeter pocket further includes an upward facing hook and a screw hole on the first leg, and the downward facing hook of the window shade rests on the upward facing hook of the perimeter pocket and the lower arm is secured to the perimeter pocket by a screw inserted into the screw hole on the first leg.

3. The perimeter pocket system of claim 1, further comprising a wire management device including a horizontal upper arm and a vertical lower arm, wherein the perimeter pocket further includes a ledge on the second arm and a screw hole on the top portion, and the vertical lower arm rests on the ledge and the horizontal upper arm is secured to the perimeter pocket by a screw inserted into the screw hole on the top portion.

4. The perimeter pocket system of claim 1, wherein the closure clip is secured to the perimeter pocket by a tether including a first screw and a second screw at each end of the tether, wherein the first screw attaches to a screw hole on the closure clip and the second screw attaches to a screw hole on the interior of the second leg of the perimeter pocket.

5. The perimeter pocket system of claim 1, wherein the closure clip is secured to the perimeter pocket by a screw inserted through the second leg of the perimeter pocket above the upward facing hook, wherein the screw prevents vertical movement of the closure clip.

6. The perimeter pocket system of claim 1, wherein the closure clip extends fully between the first leg and the second leg.

7. The perimeter pocket system of claim 1, wherein the closure clip extends only partially between the first leg and the second leg.

8. The perimeter pocket system of claim 1, further comprising an end cap including an end plate which is secured to the perimeter pocket by a plurality of screws inserted in a plurality of screw holes in one or more of the top portion, the first leg, and the second leg.

9. The perimeter pocket system of claim 8, wherein the end cap further comprises a leg perpendicular to the end plate and a notch at the intersection of the end plate and the leg.

10. The perimeter pocket system of claim 1, further comprising a ceiling beam attached to the exterior of the second leg of the perimeter pocket via a connector clip slotted between a plurality of protuberances on the exterior of the second leg.

11. The perimeter pocket of claim 10, further comprising a horizontal ledge attached to the second leg, wherein the ceiling beam rests on the horizontal ledge.

12. The perimeter pocket system of claim 1, further comprising a ceiling beam attached to the exterior of the second leg of the perimeter pocket via a connector clip slotted between a plurality of protuberances on the exterior of the second leg.

13. The perimeter pocket of claim 12, further comprising a horizontal ledge attached to the second leg, wherein the ceiling beam rests on the horizontal ledge.

* * * * *